United States Patent [19]

McLellan

[11] 4,163,557

[45] Aug. 7, 1979

[54] MOVING TARGET PRACTICE RANGE

[76] Inventor: Norvel J. McLellan, 1002 N. Main St., Pleasanton, Tex. 78064

[21] Appl. No.: 783,302

[22] Filed: Mar. 31, 1977

[51] Int. Cl.[2] ..... A63F 9/02; F41J 9/14

[52] U.S. Cl. ..... 273/101.1; 273/105.1

[58] Field of Search ..... 35/25; 273/101.1, 101.2, 273/102.2 B, 102.1B, 105.2, 105.1; 240/6.41

[56] References Cited

U.S. PATENT DOCUMENTS

| | | | |
|---|---|---|---|
| 2,042,174 | 5/1936 | Foisy | 273/101.1 |
| 2,569,594 | 10/1951 | Aagesen | 273/101.1 |
| 2,995,834 | 8/1961 | Rowe | 273/101.1 X |
| 3,904,204 | 9/1975 | Yokoi | 273/101.1 |
| 4,019,262 | 4/1977 | Breglia et al. | 273/101.1 X |
| 4,052,066 | 10/1977 | Ohta | 273/101.1 |

*Primary Examiner*—Vance Y. Hum

[57] ABSTRACT

A projector apparatus has a lamp and magnifying lens located therein with appropriate reflective mirrors for projecting a patch of light onto a screen. Inside of the patch of light is a dark spot created by a non-translucent material on the magnifying lens. A motor with a special cam moves one of the reflective mirrors to cause the patch of light and dark spot to sweep across the screen at a constant speed. A special gun electrically connected with the projector apparatus has a gun firing power unit for creating a short duration, high intensity flash of light upon the pulling of the trigger of the gun. The flash of light is reflected through appropriate mirrors onto the screen. By adjustments in the projector apparatus, compensation can be made for lead and drop of a normal cartridge which an individual is simulating firing in the gun. Automatic compensation is made in the projector apparatus and fed to the gun to adjust for the angle at which the patch of light strikes the screen thereby compensating for distance to the target in automatically adjusting lead and drop.

3 Claims, 8 Drawing Figures

MOVING TARGET PRACTICE RANGE

BACKGROUND OF THE INVENTION

This invention relates to a moving target practice range and, more particularly, to a moving target practice range having a projector apparatus for projecting a beam of light onto a screen, and a gun for projecting a high intensity, short duration flash of light. The gun has a manual compensation means for lead and drop of a normal bullet projectile, and an automatic compensation means for increased lead and drop due to the angle at which the beam of light strikes the screen.

DESCRIPTION OF THE PRIOR ART

Many different types of target practice and aiming devices have been devised in the past that use light to simulate the firing of a gun. Some of these devices employed very complicated, sophisticated electrical components, such as U.S. Pat. No. 3,870,305.

Other devices, such as U.S. Pat. No. 2,995,834, have projector apparatuses and guns that project a beam of light to simulate shooting at moving targets. However, these devices do not have a simple means for compensating for normal lead and drop of a projectile, as is necessary for a true target practice range. The device that do have some type of compensation for lead and drop are either extremely complicated or very inaccurate. None of the prior art devices known to applicant provide a means for compensating for lead and drop, and a means for giving a constant speed of sweep of a beam of light across the screen, so that an individual can determine his true capabilities during simulated firing. The beam of light should have a constant velocity across the screen, and compensation must be made in the gun for the lead and drop of the simulated projectile.

SUMMARY OF THE INVENTION

It is an object of the present invention to provide a moving target practice range with a projector apparatus for projecting a patch of light with a dark spot therein, and providing a constant sweep of the path of light and dark spot across the screen.

It is another object of the present invention to provide a moving target practice range with a gun for projecting a short duration, high intensity flash of light in response to the pulling of the gun trigger, which flash of light compensates for lead and drop of a normal bullet projectile.

The projector apparatus includes a lamp that creates a path of light with a dark spot therein on a screen by magnifying lens and reflective mirrors. By moving one of the reflective mirrors with a motor having a suitable camming mechanism, the patch of light and dark spot are simultaneously swept across the screen at a constant velocity. By use of an appropriate control mechanism including variable resistors varied by turning the shaft of the reflective mirror in the projector apparatus, compensation is automatically made in the gun for the various angles at which the patch of light may strike the screen.

By an electrical connection between the control apparatus and the gun with a flash tube therein, the gun may fire a small beam of high intensity, short duration light flash of light in the direction the gun is aimed in response to the pulling of the trigger of the gun. Also, the gun has an automatic compensating device therein electrically connected to the projector apparatus for changing the position of the reflective mirror to compensate for lead and drop of the normal bullet trajectory that an individual may simulate firing. By the simple adjustment of one of two controls on the projector apparatus to provide a variable voltage to the gun, either the lead or the drop of the gun may be changed. By varying the voltages received by the gun, solenoid mechanisms inside of the gun are varied thereby varying the position of the reflective mirror to simultaneously vary the direction of the high intensity, short duration flash of light that is created upon pulling the trigger of the gun. The gun has a firing power unit located therein for illuminating a flash tube upon the pulling of the trigger of the gun, which illumination creates the high intensity, short duration beam of light.

DESCRIPTION OF THE PREFERRED EMBODIMENT

Figure 1:
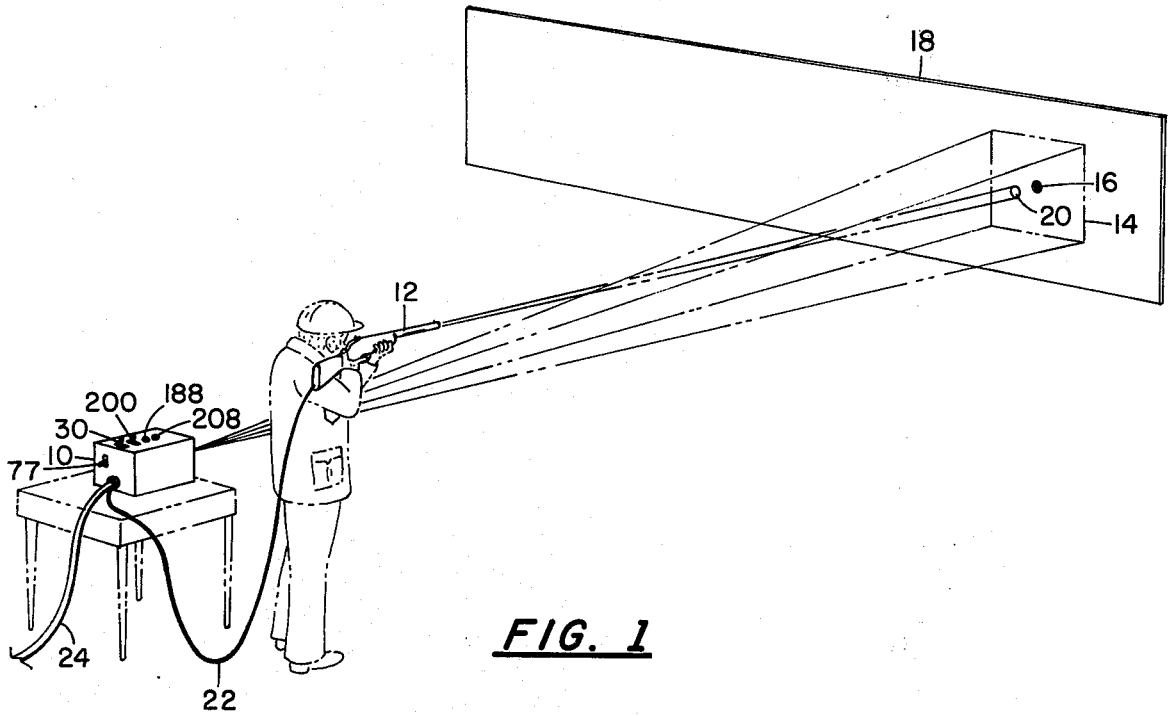
FIG. 1 is a pictorial view of an individual using the moving target practice range.

Referring now to FIG. 1, the pictorial illustration shows an individual utilizing the projector apparatus 10 and a gun 12 having a specially designed flash unit therein. The projector apparatus 10 projects a patch of light 14 having a dark spot 16 therein onto screen 18, which patch of light 14 and dark spot 16 sweep back and forth across the screen 18. Upon pulling the trigger, gun 12 will project a short duration, high intensity flash of light 20 onto the screen 18, which flash of light 20 simulates the direction in which gun 12 is aimed with appropriate compensation for lead and drop through connection 22 with projector apparatus 10. The projector apparatus 10 receives power from any suitable voltage source through power cord 24.

Figure 2:
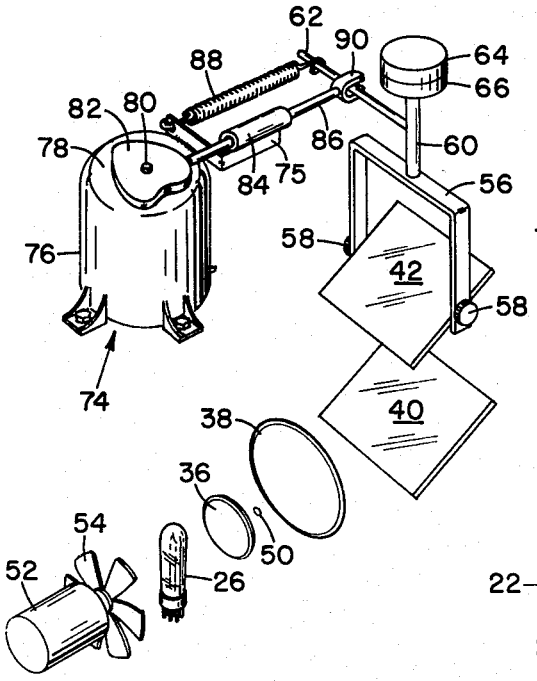
FIG. 2 is an exploded perspective view of the internal components of the projector apparatus of the moving target practice range.
Figure 3:
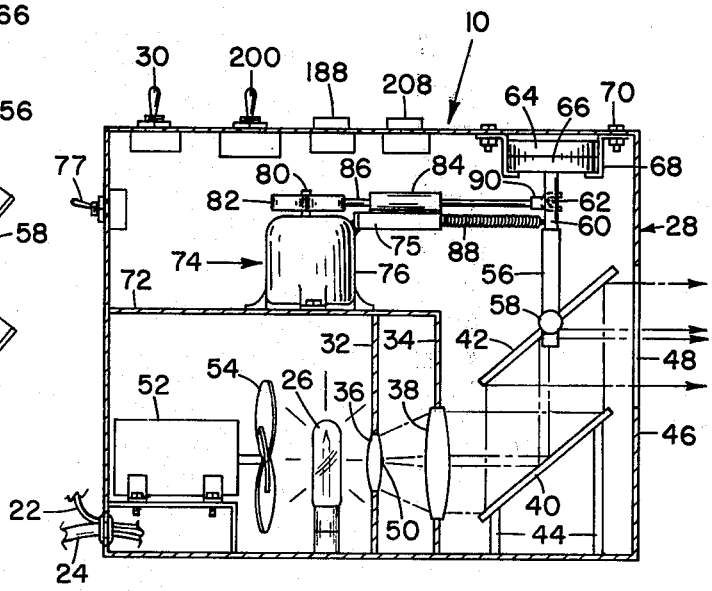
FIG. 3 is a cross-sectional view of the projector apparatus illustrating relative positions of the components therein.

Referring to FIGS. 2 and 3 in combination, the mechanical components of the projector apparatus 10 are shown in cross section and exploded perspective. Electrical connections are not shown, but will be subsequently explained in detail. A projector lamp 26 inside of housing 28 of projector apparatus 10 is illuminated by a suitable connection between ON/OFF switch 30 and power cord 24. The projector lamp 26 is located behind non-translucent walls 32 and 34, each of which has a magnifying lens 36 and 38, respectively, located therein. The magnifying lens 36 receives illumination from projector lamp 26, which illumination is transmitted therethrough to magnifying lens 38. Magnifying lens 38 further transmits the light therethrough to reflective mirror 40. The reflective mirror 40 is mounted in a stationary position at approximately a 45° angle by supports 44 attached to housing 28. The reflective mirror 40 reflects the illuminated light received from magnifying lens 38 upward to moveable reflective mirror 42. The moveable reflective mirror 42 is located directly above reflective mirror 40. When the illumination being reflected by reflective mirror 40 and moveable reflective mirror 42 leaves housing 28 through opening 48 and is generally perpendicular to the forward edge 46, then moveable reflective mirror 42 is approximately parallel to reflective mirror 40.

A non-translucent material 50, such as a small piece of tape, is attached to the center of magnifying lens 36. Therefore, as the illumination from magnifying lens 36 and 38 is reflected by mirrors 40 and 42, there will be a dark spot in the center that is not illuminated. As the illumination is reflected onto screen 18 (see FIG. 1), the dark spot 16 will appear inside of the patch of light 14, which patch of light 14 is the illumination from projector lamp 26.

To insure that the projector apparatus 10 does not over heat, especially due to the projector lamp 26, a cooling fan motor 52 is connected via the ON/OFF switch 30 and the power cord 24 to a suitable source of electric voltage. The cooling fan motor 52 drives fan 54 for cooling the projector apparatus 10. The fan 54 will draw air into the projector apparatus 10 via air vents (not shown) in the housing 28.

The moveable reflective mirror 42 is connected to yoke 56 by means of a threaded connection (not shown) with knobs 58. Knobs 58 form a horizontal rotational axis for reflective mirror 42 to adjust the height of the patch of light 14 on the screen 18. Between knobs 58 and moveable reflective mirror 42 is a rubber grommet (not shown) that will allow rotational movement of the moveable reflective mirror 42 about the horizontal axis that extends through knobs 58 by pushing on the upper or lower edge of the reflective surface 42 through opening 48. The rotational movement about the horizontal axis will adjust the height of the patch of light 14 on screen 18.

The uppermost portion of the yoke 56 is rigidly connected to shaft 60 which has a horizontal connecting arm 62 extending therefrom. The upper end of the shaft 60 connects to variable resistors 64 and 66, which variable resistors 64 and 66 are held into position by brackets 68 and bolts 70.

Mounted on support structure 72 that also holds non-translucent walls 32 and 34 in position is a gear box motor 74 inside of motor housing 76. Extending through the top 78 of the motor housing 76 is a motor shaft 80. Rigidly connected to the motor shaft 80 is a cam 82. Rigidly mounted to the housing 76 by support structure 75 is a cylinder 84 that slideably receives shaft 86 therethrough. One end of shaft 86 rubs against the side of cam 82, and the other end of shaft 86 is held in contact with horizontal connecting arm 62 by means of cam spring 88 connected under tension between support structure 75, motor housing 76 and the end of connecting arm 62. Yoke 90 insures that the end of shaft 86 in contact with horizontal connecting arm 62 maintains contact therewith.

The gear box motor 74 is connected through ON/-OFF switch 30 and power cord 24 to a suitable source of electric power. Upon applying power to the gear box motor 74, the motor shaft 80 will turn at a predetermined rate. By experimentation, applicant has determined that one revolution of motor shaft 80 every eight to ten seconds is about the maximum frequency of sweep of the patch of light 14 and dark spot 16 across screen 18 that is realistic while attempting to improve an individual's shooting capabilities. The particular configuration of the cam 82, which is followed by the shaft 86 and maintains an abutting relationship with horizontal connecting arm 62 by cam spring 88, causes the shaft 86 to oscillate back and forth. The oscillation of the shaft 86 in turn causes the yoke 56 and the moveable reflective mirror 42 located thereon to move back and forth resulting in the patch of light 14 and dark spot 16 oscillating back and forth across the screen 18. Simultaneously, the oscillation of shaft 60 causes the resistance in variable resistors 64 and 66 to vary thereby giving a compensating voltage for the various angles at which the patch of light 14 will be striking the screen 18. The compensating voltage is used to compensate for increased distance to the target due to the angle the patch of light 14 strikes the screen 18. Interconnection of the variable resistors 64 and 66 with the control circuitry will be subsequently explained. The particular design of the cam 82 insures that the sweep across the screen is substantially constant.

Figure 4:
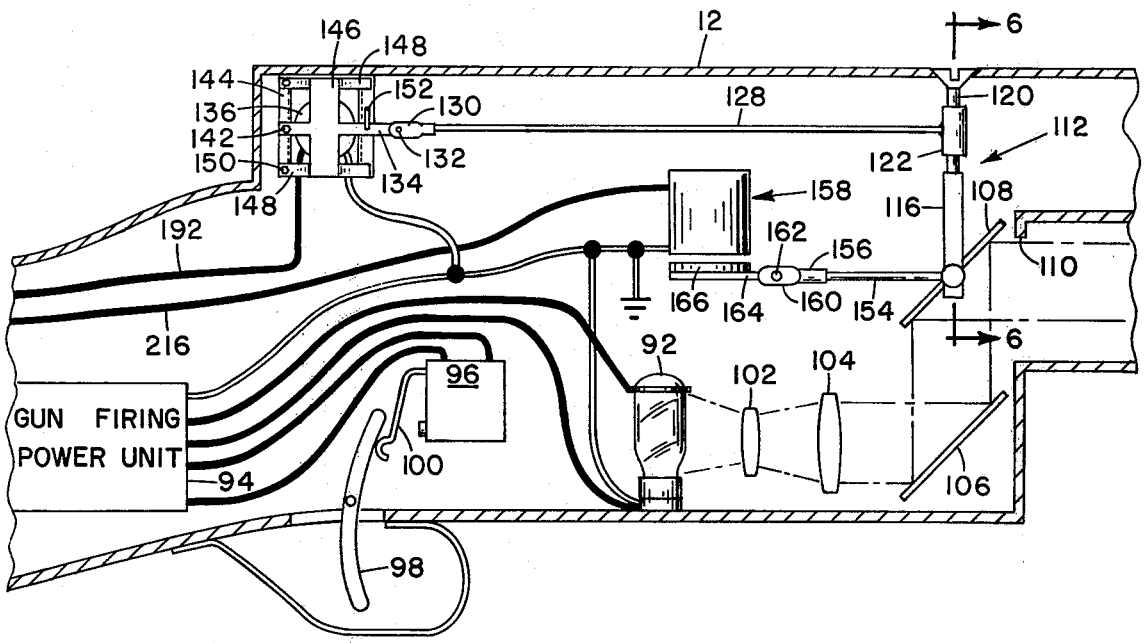
FIG. 4 is a partial sectional view of a gun illustrating the special components contained therein for projecting a beam of light in response to pulling the trigger.

Referring to FIG. 4, a partial cross-sectional view of the gun 12 is shown. Inside of the gun 12 there is a flash tube 92 that may receive a voltage from gun firing power unit 94 through trigger switch 96. By the pulling of trigger 98, the trigger switch lever 100 will close trigger switch 96 to apply a short duration, high voltage to flash tube 92 to cause illumination. The illumination of flash tube 92 will be transmitted through magnifying lens 102 and 104, and reflected by stationary mirror 106. The reflection of the illumination (which illumination is a short duration, high intensity flash of light) will be reflected from stationary mirror 106 to moveable mirror 108 and through opening 110 of the gun 12.

Figure 6:
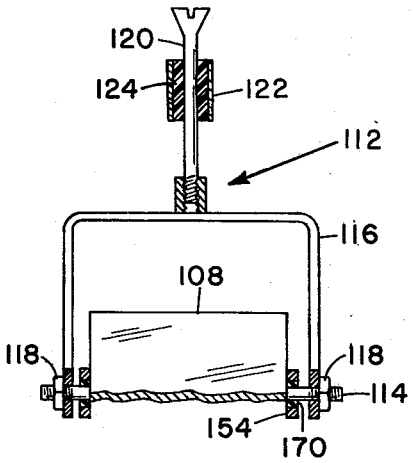
FIG. 6 is a partial sectional view of the adjustable reflective mirror of the gun.

Mounting structure 112 for the moveable mirror 108 is shown in a sectional view in FIG. 6, taken along section lines 6—6 of FIG. 4. The moveable mirror 108 is mounted on axis 114 which extends through yoke 116 and is held in position by nuts 118. Yoke 116 is threadably connected to screw 120 that extends through the top of gun 12. Screw 120 is maintained in a relatively fixed position by rubber grommet 124. A connecting rod 128 is connected to screw 120 by connecting sleeve 122, which is welded thereto, and rubber grommet 124. The connecting rod 128 is attached to yoke 130 via pin 132 and to a resilient member 134. The resilient member 134 is connected to an armature 136 of lead coil 138.

Figure 5:
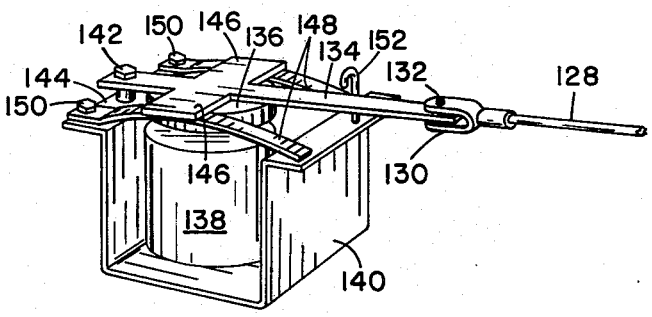
FIG. 5 is a pictorial view of the solenoids used in the gun for compensating for lead and drop of the projected beam of light.

The lead coil 138 is shown in more detail in FIG. 5 with the lead coil 138 being mounted in housing 140. The resilient member 134 is held in position by bolt 142 attached to flange 144 of housing 140. Located under horizontal extensions 146 of resilient member 134 are springs 148 for urging the resilient member 134 upward. The springs 148 are held in position on flange 144 by nuts 150. Stop 152 prevents the resilient member 134 from moving beyond a predetermined distance thereby preventing excessive movement of connecting rod 128, connecting sleeve 122, rubber grommet 124, screw 120 and mirror 108.

Figure 7:
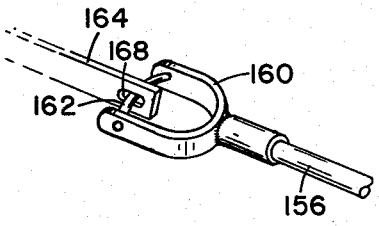
FIG. 7 is a perspective view of the coupling yoke between the drop solenoid and the reflective mirror.

Located inside of yoke 116 is another yoke 154 which connects through connecting rod 156 to another solenoid 158. Solenoid 158 is substantially identical to lead coil 138, except connecting rod 156 is connected through yoke 160 and curved pin 162 to resilient member 164 in a manner generally parallel to resilient member 164. (See FIG. 7) Resilient member 164 has an armature 166 mounted thereon the same as armature 136 of lead coil 138. Also to accommodate for rotational movement of the mirror 108 about screw 120, the pin 162 is slightly curved as illustrated in FIG. 7. Further, the resilient member 164 is connected to pin 162 by means of a slot 168. Movement of the resilient member 164 up or down as shown in FIG. 4 will cause the moveable mirror 108 to rotate about axis 114 because of a rubber grommet 170 located inside of the connection with yoke 154. Such movement will adjust the elevation to account for drop of a simulated projectile.

Figure 8:
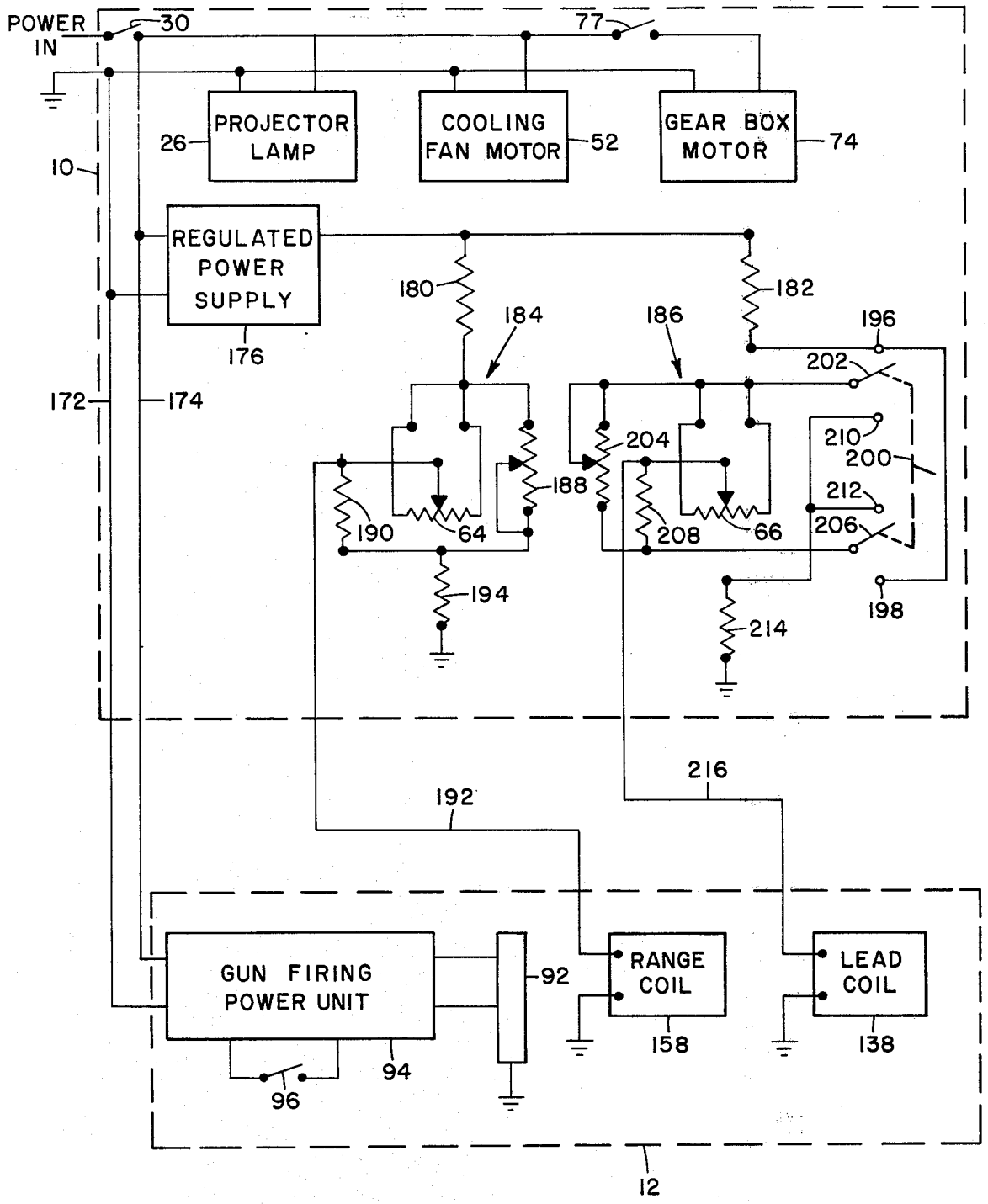
FIG. 8 is a schematic diagram of the electrical controls for the moving target practice range.

Referring now to the electrical schematic shown in FIG. 8 in conjunction with the preceding figures, the control of the moving target practice range will be explained in detail. Power is received both inside of the projector apparatus 10 and gun 12 by means of leads 172 and 174. Upon closure of the ON/OFF switch 30, power is applied to the projector lamp 26, cooling fan motor 52 and gear box motor 74. The applying of power will cause the projector lamp 26 to illuminate and the cooling fan motor 52 to turn fan 54 for cooling, and the gear box motor 74 to rotate the cam 82. Simultaneously, power is applied to a regulated power supply 176 in projector apparatus 10, and a gun firing power unit 178 in gun 12. The regulated power supply 176 supplies a regulated voltage through limiting resistors 180 and 182 to a range circuitry 184 and a lead circuitry 186. The voltage from limiting resistor 180 is received to both sides of variable resistor 64 previously described in conjunction with FIG. 3. The wiper arm of variable resistor 64 is connected in parallel with an externally adjustable variable resistor 188 and balance resistor 190. The parallel connection is then connected through lead 192 to range coil 158.

Compensating resistor 194 is connected between externally adjustable variable resistor 188 and balance resistor 190 to ground.

Limiting resistor 182 is connected to contacts 196 and 198 of double pole, double throw switch 200. Wiper arm 202 is connected to both sides of variable resistor 66 previously described in conjunction with FIG. 3. Also, wiper arm 202 connectes to one side of externally adjustable variable resistor 204 and its wiper arm. Wiper arm 206 connects to the opposite side of externally adjustable variable resistor 204 and to balance resistor 208. Balance resistor 208 in turn is connected to the wiper arm of variable resistor 66. Contacts 210 and 212 of double pole, double throw switch 200 are connected through compensating resistor 214 to ground. Connection from the lead circuitry 186 to the lead coil 158 is made via lead 216 which connects to the wiper of variable resistor 66 and the balance resistor 208. By changing the position of the double pole, double throw switch 200, the voltage of the lead coil 156 may be changed in either the positive or the negative direction, depending upon the direction sweep an individual is using across screen 18 while practicing his aim. It should be realized that all of the leads 172, 174, 192 and 216 are combined in a single connection 22 between the gun 12 and the projector apparatus 10.

METHOD OF OPERATION

An individual using the moving target practice range would need to connect the projector apparatus of a suitable source of electric power through power cord 24. By turning the ON/OFF switch 30 to the ON position, the reflector lamp 26 will be illuminated, and the cooling fan motor 52 and the gear box motor 74 turned ON. The regulated power supply 176 will supply a suitable regulated voltage to the range circuitry 184 and the lead circuitry 186.

As the gear box motor 74 turns, the cam 82 will rotate thereby causing the moveable reflective mirror 42 to oscillate back and forth. The turning of shaft 60, which causes the oscillation of moveable reflective mirror 42, also turns variable resistors 64 and 66. The turning of variable resistors 64 and 66 compensate in the gun for the angle at which the patch of light 14 and dark spot 16 strike the screen 18. The electrical connection of the variable resistors 64 and 66 in the range circuitry 184 and the lead circuitry 186, respectively, is shown in detail in FIG. 8.

Before firing gun 12 at the dark spot 16 as it sweeps across screen 18, the gun 12 must be adjusted for lead and drop. For the type of projectile an individual is simulating the firing from gun 12, the velocity of the bullet and the drop of the bullet for a given distance can be obtained from standard manufacturers' catalogues. By knowning the distance from the screen 18 to the projector apparatus 10, an individual can calculate the amount of drop that will occur if a real bullet was fired in gun 12. Also, by knowing the velocity of the sweep of dark spot 16 across screen 18, an individual can calculate the amount of lead necessary for the projectile that he is simulating firing. To accurately set the gun 12, the motor switch 77 is opened thereby preventing further turning of the cam 82 by gear box motor 74. The cam 82 is positioned so that the dark spot 16 is perpendicular to the screen 18 and unhooking spring 88. Thereafter, the individual (assuming that he is planning on firing at the dark spot 16 as it sweeps from left to right on screen 18) will put a piece of tape on screen 18 that will be to the right of and above dark spot 16, which tape would account for lead and drop of the bullet. Thereafter, if the individual returns to the projector apparatus 10 and aims for the point that is marked on the screen 18, and fires the gun 12 by means of gun firing power unit 178 connected through trigger switch 96 to flash tube 92, the short duration, high intensity flash of light 20 should strike dark spot 16. Assuming that the flash of light 20 strikes below dark spot 16, the adjustment for range is made by pushing the top edge of the adjustable mirror 108.

Assume now that the flash of light 20, upon aiming at the spot marked on screen 18, will strike to the left of dark spot 16. Adjustment for lead is made by turning screw 120 to the right. After the adjustment of the vertical and horizontal planes, if an individual aims at the spot marked on the screen 18 and fires the gun 12, the flash of light 20 should coincide with the dark spot 16. Now the dark spot 16 is moved to the right two-thirds of the screen 18 and a piece of tape is put on the screen 18 in the position that would account for the lead and drop of the bullet at the new angle and range to the target. The adjustment for lead is made by adjusting resistor 204. The adjustment for the range is made by adjusting resistor 188.

Thereafter by rehooking spring 88 and by closing motor switch 77, the cam 82 will rotate causing the patch of light 14 and dark spot 16 to sweep back and forth across screen 18. By aiming at the dark spot 16 with proper accounting in the aim for lead and drop as the dark spot 16 sweeps from left to right, upon firing the gun, the flash of light 20 should coincide with the dark spot 16, if the aim is proper. If the individual desires to practice while the sweep is from right to left on screen 18, the position of switch 200 will have to be changed, but no further adjustment should be necessary for range if the individual is simulating the firing of the same type of bullet. The lead will have to be changed from right lead to left lead. If the individual desires to simulate the firing of a different type of bullet that has different trajectory characteristics, then the lead and drop would have to be recalculated and the gun recalibrated as previously described hereinabove.

By the use of a high intensity flash of light 20, and a bright projector lamp 26, the moving target practice range can be used in normal daytime hours. The screen 18 could be the side of a building or other structure, as long as it is a relatively vertical plane.

Major adjustments in the vertical trajectory of the patch of light 14 may be made by inserting a finger through opening 48 and pushing against moveable reflective mirror 42 to adjust its vertical position. (See FIG. 3). Likewise, in gun 12 major adjustments in the vertical trajectory of the flash of light 20 can be made by inserting a finger through opening 110 and pushing against the moveable mirror 108. (See FIG. 4) Major adjustments in the lead of gun 12 can be made by turning screw 120.

The gun firing power unit 94 can be any type of charging circuit, such as a charge capacitor that is discharged across flash tube 92 upon pulling the trigger 98 to close trigger switch 96.

I claim:

1. A moving target practice range for simulating the firing of a gun using projected light on a screen comprising:

a source of power;

projector apparatus connected to said source of power;

light means inside said projector apparatus receiving voltage from said source of power;

first reflector means inside said projector apparatus for reflecting at least a portion of illumination from said light means approximately perpendicular to said screen;

cam means driven by a motor means connected to said source of power, said cam means being operatively connected to said first reflector means to cause a substantially constant velocity sweep of said reflected illumination on said screen upon oscillation of said first reflector means by said cam means;

gun means connected to said projector apparatus for receiving adjustments therefrom, said gun means having flash means therein connected to said source of power and trigger means of said gun means for generating a flash of light upon pulling of said trigger means;

second reflector means in said gun means for reflecting said flash of light in approximately the same direction said gun means is pointed;

manual adjustment means varies adjustment voltages received by vertical positioning means and horizontal positioning means, said vertical positioning means moving said second reflector means in response to said adjustment voltages to compensate for said drop, and said horizontal positioning means moving said said reflector means in response to said adjustment voltages to compensate for said lead;

projector apparatus having automatic adjustment means connected to said cam means for varying therewith to change said adjustment from said projector apparatus to said gun means in response to angle of said reflected illumination to said screen, said adjustment changing said lead and said drop in response to said angle;

vertical positioning means comprises a vertical solenoid means connected to a horizontal axis of a second mirror of said second reflector means, and said horizontal positioning means is a horizontal solenoid means connected to a vertical axis of said second mirror;

manual adjustment means is located in said projector apparatus for varying said adjustment therefrom to said vertical solenoid means and horizontal solenoid means;

automatic adjustment means are variable resistors operatively connected to said cam means, said variable resistors providing said adjustment voltage to said vertical solenoid means and said horizontal solenoid means to automatically compensate for said lead and said drop caused by increased distance to the reflected illumination as said angle changes.

2. The moving target practice range as given in claim 1 wherein said cam means is connected to a vertical shaft for rotating a first mirror of said first reflector means, said vertical shaft simultaneously varying angle compensating resistor means to vary said adjustment from said projector apparatus to said gun.

3. The moving target practice range as given in claim 1 wherein a non-translucent member is located on lens means between said light means and said first reflector means to produce a dark spot inside said reflected illumination, said dark spot being the target.

* * * * *